US007619564B2

(12) United States Patent
Chang et al.

(10) Patent No.: US 7,619,564 B2
(45) Date of Patent: Nov. 17, 2009

(54) WIDEBAND DIELECTRIC RESONATOR MONOPOLE ANTENNA

(75) Inventors: Tze-Hsuan Chang, Taipei (TW); Jean-Fu Kiang, Taipei (TW)

(73) Assignee: National Taiwan University, Taipei (TW)

( * ) Notice: Subject to any disclaimer, the term of this patent is extended or adjusted under 35 U.S.C. 154(b) by 456 days.

(21) Appl. No.: 11/466,454

(22) Filed: Aug. 23, 2006

(65) Prior Publication Data

US 2008/0048915 A1 Feb. 28, 2008

(51) Int. Cl.
*H01Q 1/38* (2006.01)

(52) U.S. Cl. ..... 343/700 MS; 343/767

(58) Field of Classification Search ..... 343/767, 343/770

See application file for complete search history.

(56) References Cited

U.S. PATENT DOCUMENTS 6,995,713 B2 * 2/2006 Le Bolzer et al. ..... 343/700 MS 7,196,663 B2 * 3/2007 Bolzer et al. ..... 343/700 MS

OTHER PUBLICATIONS

M. S. Al Salameh et al., "Coplanar-Waveguide-Fed Slot-Coupled Rectangular Dielectric Resonator Antenna", Oct. 2002, IEEE Transactions on Antennas and Propagation, vol. 50, No. 10, pp. 1415-1417.*

Amelia Buerkle et al., "Compact Slot and Dielectric Resonator Antenna with Dual-Resonance", Broadband Characteristics, Mar. 2005, IEEE Transactions on Antennas and Propagation, vol. 53, No. 3, pp. 1020-1027.*

Q. Rao et al., "On Improving Impedance Matching of a CPW Fed Low Permittivity Dielectric Resonator Antenna", 2005, Progress In Electromagnetics Research, PIER 53, pp. 21-29.*

* cited by examiner

*Primary Examiner*—Michael C Wimer
*Assistant Examiner*—Kyana R Robinson

(57) ABSTRACT

A wideband dielectric resonator monopole antenna, which includes a dielectric resonator and a monopole antenna, combines two frequency bands having close resonant frequencies to achieve 49% of bandwidth and omnidirectional radiation patterns within the frequency band. It includes a column structure and a substrate, wherein the surface of the column structure is coated with a conductive layer, the column structure is kept upright to the substrate, and the substrate is coated or printed with two slot lines extended inward from an edge of the substrate.

10 Claims, 7 Drawing Sheets

WIDEBAND DIELECTRIC RESONATOR MONOPOLE ANTENNA

BACKGROUND OF THE INVENTION

1. Field of the Invention

The present invention relates to an antenna combining a dielectric resonator with a monopole.

2. The Prior Arts

With the advancement of wireless communication technology, portable devices have been widely used in various applications, such as industry, science, and medicine, and are also getting more diversified. Their major requirements are portability and low power. Therefore, how to reduce the size and power consumption of the product becomes important design considerations. For example, if the wireless LAN 802.11a in the 5.25 GHz frequency band adopts ordinary microstrip antenna, the ohmic loss will be excessive due to high operating frequency. Since the dielectric resonator basically has no ohmic loss, it has the advantages of low loss rate, high radiation efficiency and high gain, and is extremely suitable to be operated in high frequency. However, the dielectric constant of the prior dielectric resonators is approximately below 10, and its size is greater than that of the microstrip antenna. Thus, the dielectric resonator antenna is often designed using high dielectric constant to reduce the size. But increasing the dielectric constant often results in a reduction of the operating frequency bandwidth of the antenna, thereby not meeting the bandwidth requirement within the frequency band. Therefore, it is desired to provide a novel and improved wideband dielectric resonator monopole antenna that can solve the above-mentioned problems.

SUMMARY OF THE INVENTION

A primary objective of the present invention is to provide a novel antenna, which is a combination of the dielectric resonator and the monopole antenna, and combines the frequency bands of these two antennas by a coplanar waveguide feed system, to achieve 49% of bandwidth.

Another objective of the present invention is to provide a novel antenna, which is a combination of the dielectric resonator and the monopole, with an omnidirectional radiation pattern, for reducing the poor signal reception conditions due to the changes and movements of signal reception location.

Furthermore, the antenna structure in accordance with the present invention, which mainly utilizes the coplanar waveguide (CPW) feed, is simple and can be easily integrated into other planar circuits. It is a widely used and easily manufactured antenna structure. Since its antenna radiation pattern within the frequency band has the omnidirectional characteristic, it is suitable to be used in the wireless LAN such as WLAN 802.11a, which requires an omnidirectional radiation pattern.

DETAILED DESCRIPTION OF THE PREFERRED EMBODIMENT

In the following, the present invention will be described in detail with reference to the attached drawings and component numerals, and it can be carried into effect by those skilled in the art after reading it.

Figure 1:
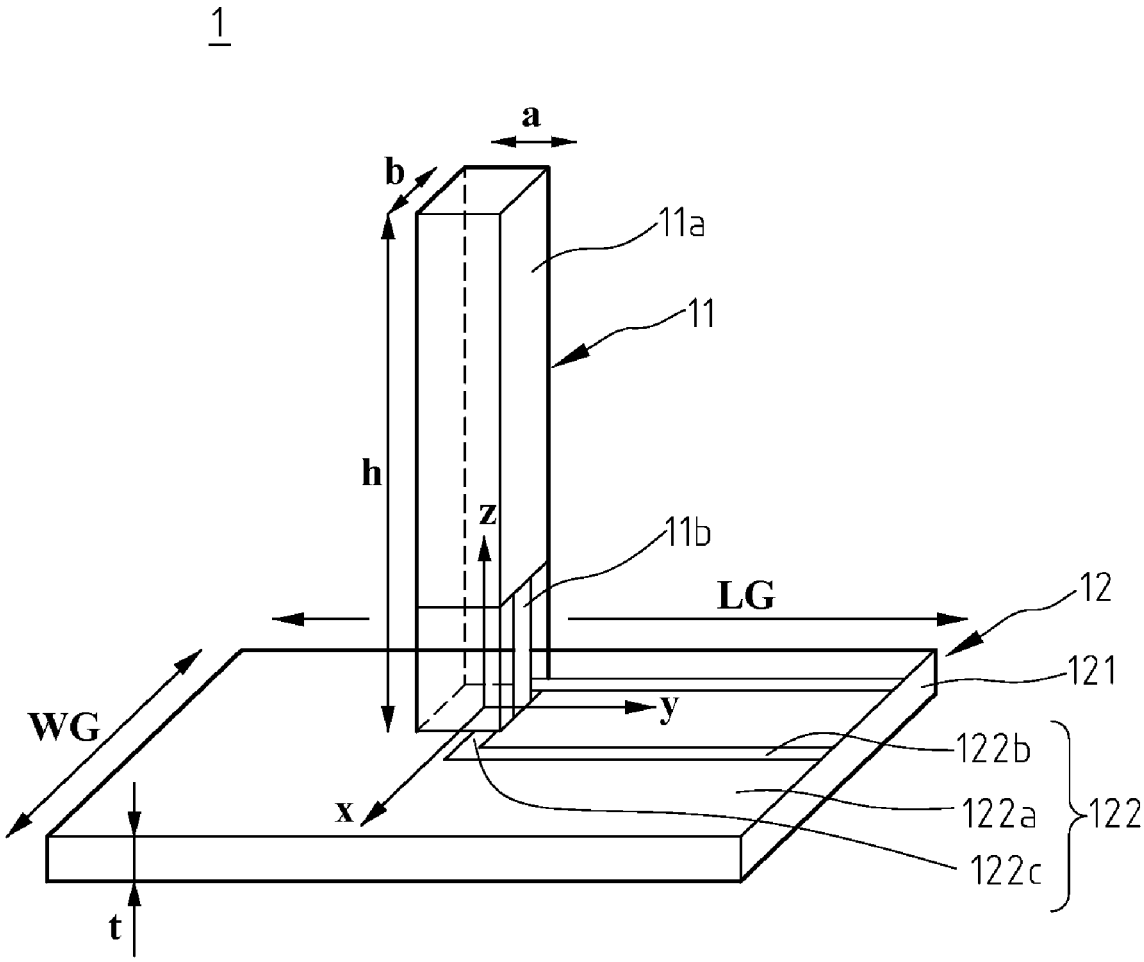
FIG. 1 is a perspective view showing a preferred embodiment of the antenna structure in accordance with the present invention.
Figure 2:
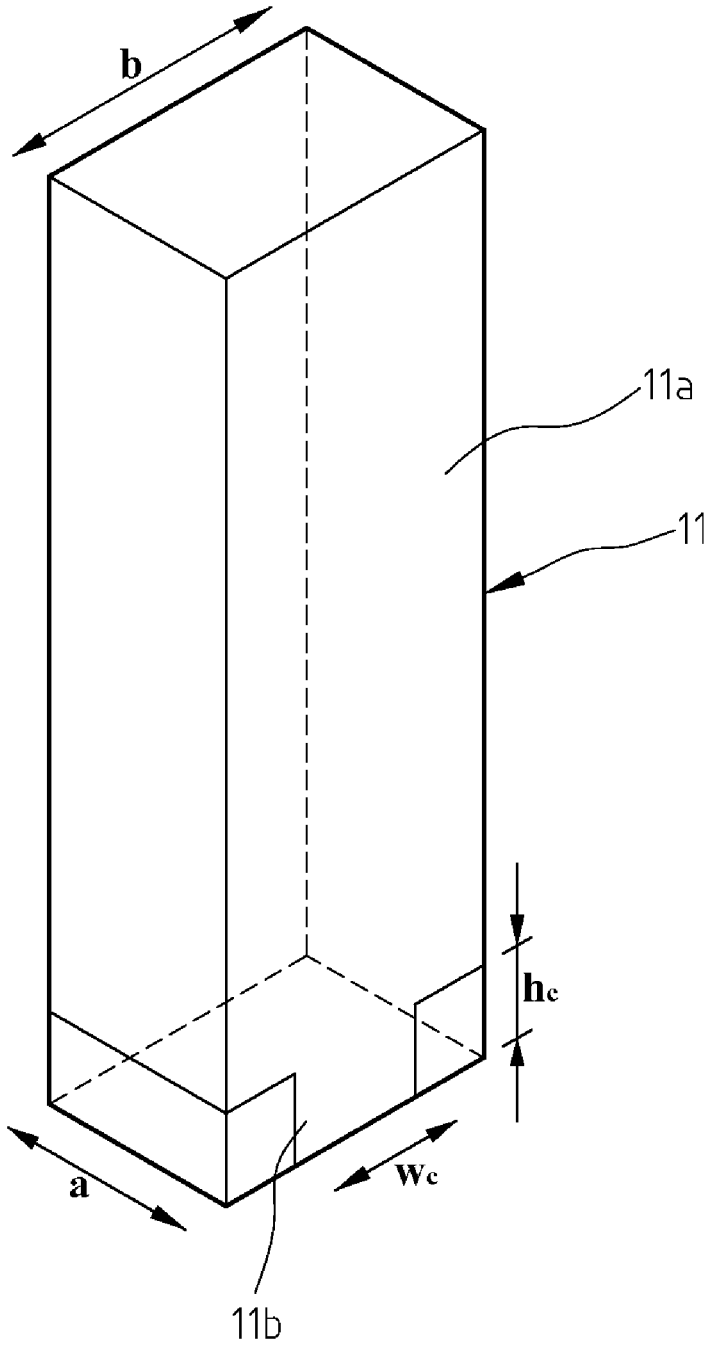
FIG. 2 is a perspective view showing a resonator in FIG. 1 in accordance with the present invention.

With reference to FIGS. 1 and 2, an antenna structure 1 in accordance with the present invention is used to receive and transmit signals, which mainly comprises a resonator 11 and a feed-in/feed-out component 12. The resonator 11 can receive electromagnetic signals in the space or transmit electromagnetic signals into the space. The feed-in/feed-out component 12 is used to import or export the signals received or transmitted by the resonator 11.

In the above-mentioned antenna structure in accordance with the present invention, the resonator 11 is a column structure. Part of the exterior surface of the resonator 11 is coated with a metal layer 11*a*, which is made of conductive material, and a connector 11*b* is formed at the bottom end of the metal layer 11*a*, to be electrically connected to the feed-in/feed-out component 12. In particular, as FIG. 2 shows, the resonator 11 is a rectangular column with a resonator width a, a resonator length b and a resonator height h. The connector 11*b* is a metal strip connector with a connector height hc and a connector width wc. The resonator width a, the resonator length b and the resonator height h of a preferred embodiment are 3.3 mm, 5.7 mm and 12 mm, respectively. The metal layer 11*a* is formed on the three adjacent surfaces of the column of the resonator 11. The distance from the bottom end of the metal layer 11*a* to the bottom edge of the rectangular column of the resonator 11 is the connector height hc of the connector 11*b*. Part of the bottom end of the metal layer 11*a* extends and forms the connector 11*b* to the bottom edge of the rectangular column of the resonator 11. The connector height hc and the connector width wc of the preferred embodiment are 0.5 mm and 3.75 mm, respectively.

The coating area or coating height of the metal layer 11*a* of the above-mentioned resonator 11 is used to adjust the resonant frequency of the resonator 11.

Figure 3:
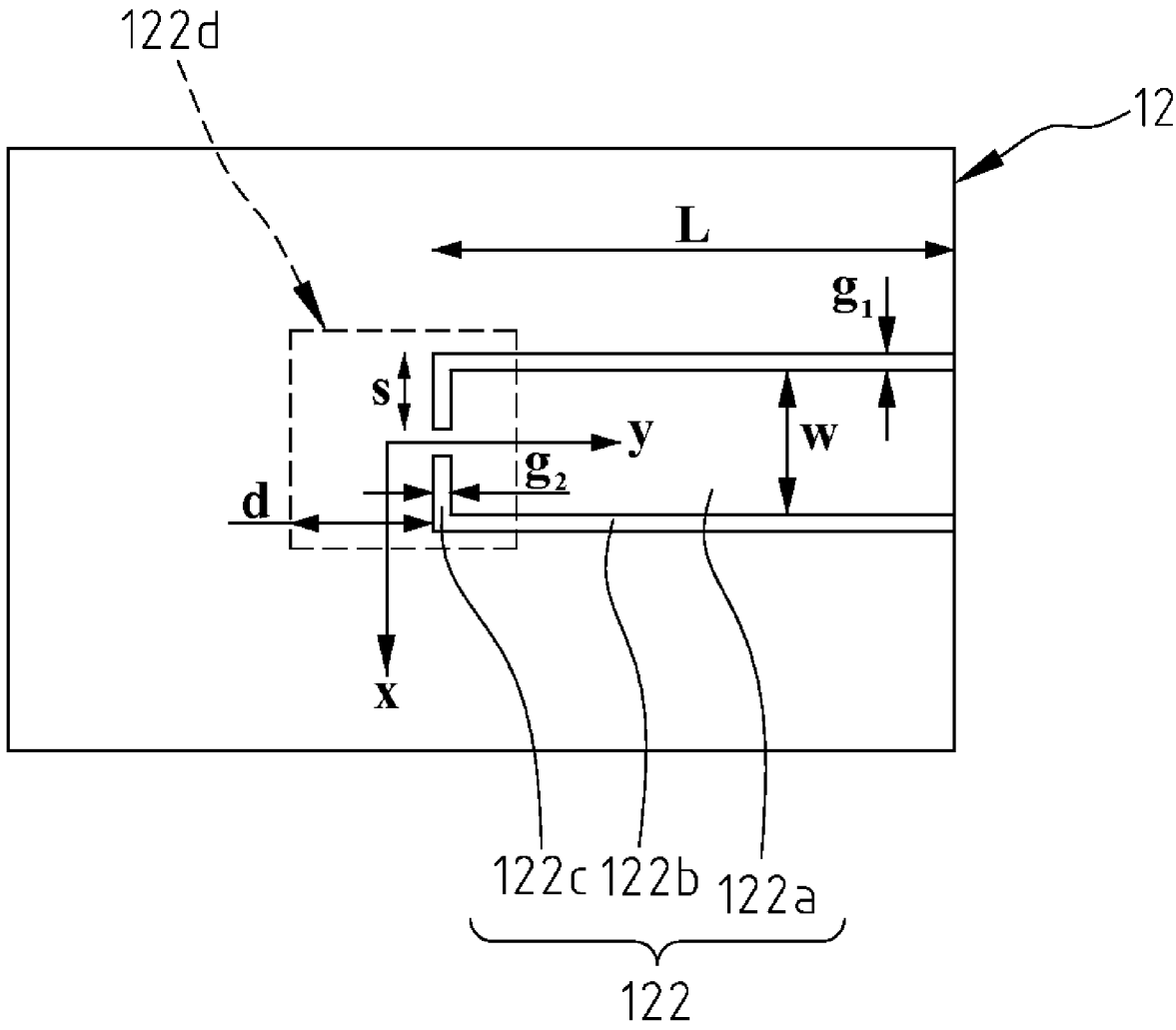
FIG. 3 is a top view showing a feed-in/feed-out component in FIG. 1 in accordance with the present invention.

With reference to FIGS. 1 and 3, in the above-mentioned antenna structure in accordance with the present invention, the feed-in/feed-out component 12 is made up of a wire pattern 122 coated or printed on a substrate 121. Wherein the substrate 121 with a substrate thickness t is made of a dielectric material such as FR4, Teflon, Duriod, fiberglass, aluminum oxide, ceramic materials, and so on; and, the wire pattern 122 is made of metal, with a grounding length LG and a grounding width WG, respectively. The wire pattern 122 comprises a grounding part 122*a*, parallel slot lines 122*b* and open circuited slot lines 122*c*, and defines a resonator footprint region 122*d*. The grounding part 122*a* is made of conductive material. It is used to ground the feed-in/feed-out component 12, and to electrically connect with the connector 11*b*. The parallel slot lines 122*b* and the open-circuited slot lines 122*c* are the part of the wire pattern 122 where conductive material is removed. FIG. 1 shows that the connector 11*b* is electrically connected to the grounding part between the two parallel slot lines 122*b*. The parallel slot lines 122*b* are made up of two parallel slot lines, with a parallel slot length L, a parallel slot width g1 and a parallel slot spacing w. The open-circuited slot lines 122*c* are made up of two open-circuited slot lines, with an open-circuited slot width g2 and an open-circuited slot length s. Each open-circuited slot line 122*c* is vertically extended from the end of the parallel slot line 122*b* close to the resonator foot-print region 122*d*, and the distance between the open-circuited slot line 122*c* and the backside of the resonator 11 is d. The wiring pattern 122 may incur a coupling effect of the electromagnetic signals associated with the resonator 11. In particular, as FIG. 3 shows, the feed-in/feed-out component 12 according to the preferred embodiment is coated or printed on a rectangular substrate 121, on which the feed-in/feed-out length, feed-in/feed-out width, and feed-in/feed-out height are 75 mm, 75 mm, and 0.5 mm, respectively. The parallel slot spacing w, which is the distance between the parallel slot lines 122*b*, is 0.5 mm. The parallel slot length L is 39 mm. The inner end of each parallel slot line 122*b* turns 90 degrees and extends toward the other parallel slot line 122*b* to form the open-circuited slot line 122*c*. An open-circuited slot opening, which is between the two ends of the two open-circuited slot lines 122*c*, is approximately 0.25 mm long. In addition, the distance d between the backside of the resonator 11 and the open-circuited slot line 122*c* is 0.5 mm.

The open-circuited slot width g2 and the open-circuited slot length s of the above-mentioned open-circuited slot lines 122*c* are used to adjust the impedance matching. The open-circuited slot length s is chosen slightly shorter than the parallel slot spacing w, and the open-circuited slot width g2 is chosen close to the parallel slot width g1.

Furthermore, the dimensions of the rectangular column of the resonator 11 and the open-circuited slot length s of the open-circuited slot lines 122*c* are used to adjust the impedance matching and the resonant frequency. When the distance d between the open-circuited slot line 122*c* and the backside of the resonator 11 is about one-seventh to one-sixth of the resonator width a of the rectangular column of the resonator 11, the antenna structure is optimized.

Figure 4:
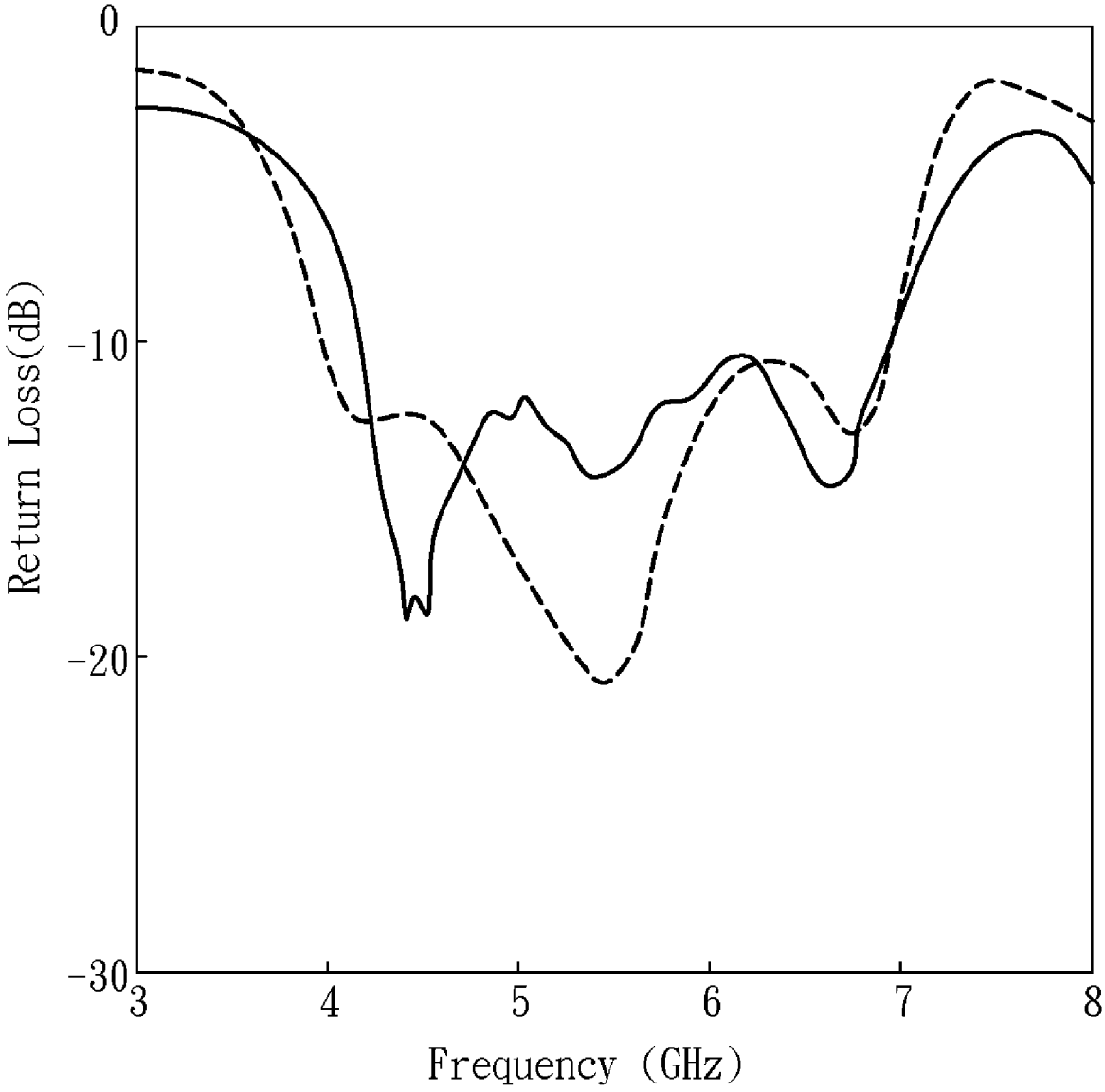
FIG. 4 is a graph showing the relation between frequency and return loss of the preferred embodiment of the antenna in accordance with the present invention.

With reference to FIG. 4, the relevant parameters according to another preferred embodiment are: the resonator width a is 3.3 mm; the resonator length b is 5.7 mm; the resonator height h is 12 mm; the parallel slot spacing w is 10 mm; the parallel slot width g1 is 0.5 mm; the open-circuited slot width g2 is 0.5 mm; the distance d between the backside of the resonator and the open-circuited slot line is 0.5 mm; the open-circuited slot length s is 5.375 mm; the connector height hc is 0.5 mm; the connector width wc is 3.75 mm; the parallel slot length L is 39 mm; the grounding length LG is 75 mm; the grounding width WG is 75 mm; and the substrate thickness t is 0.6 mm. FIG. 4 shows the relation between frequency and return loss of the preferred embodiment of the antenna structure in accordance with the present invention, wherein the solid line shows the data measured from experiments, and the dash line shows the data simulated by a software package. FIG. 4 shows that the bandwidth measured from experiments is close to the simulated bandwidth.

Figure 5:
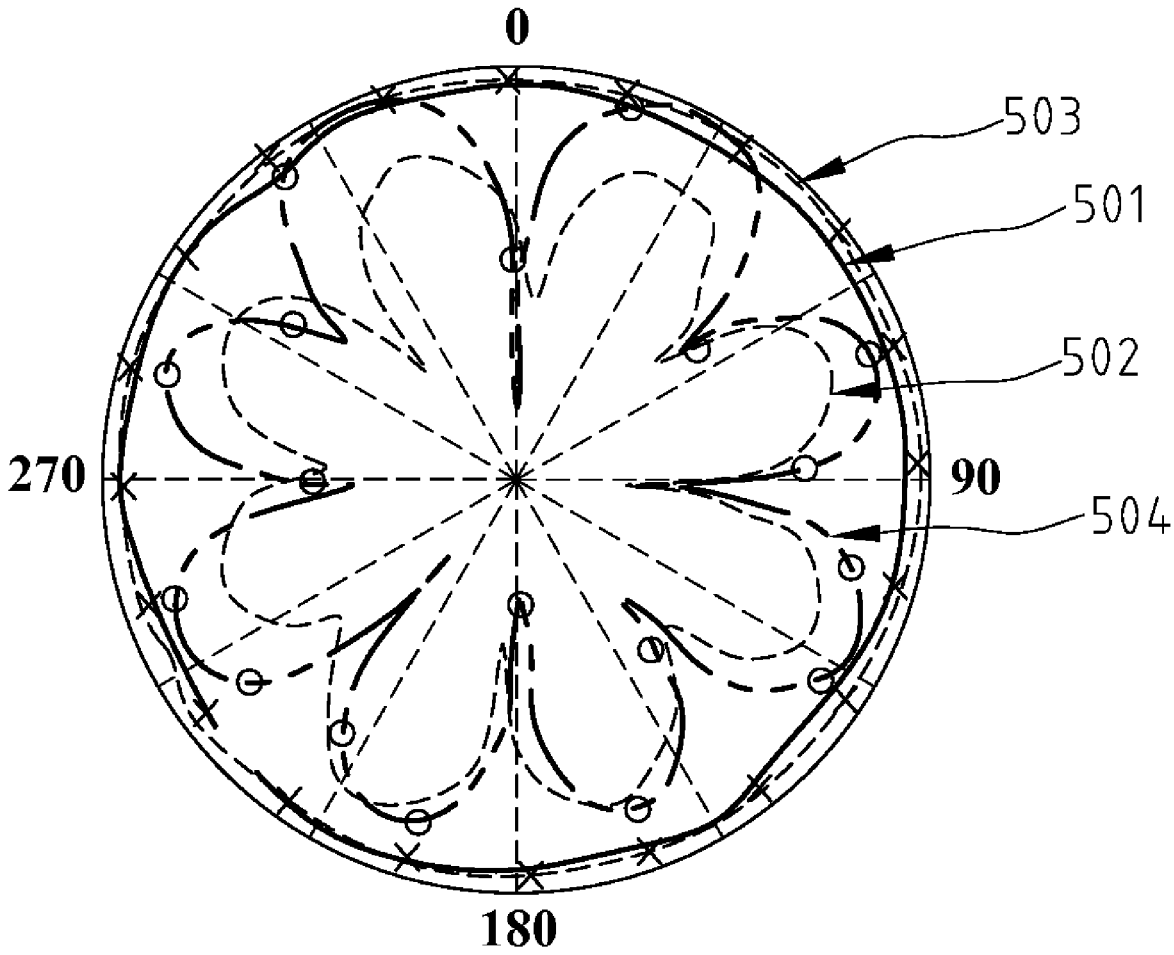
FIG. 5 is a radiation pattern of the antenna in accordance with the present invention in the XY-plane at the frequency of 5.3 GHz.
Figure 6:
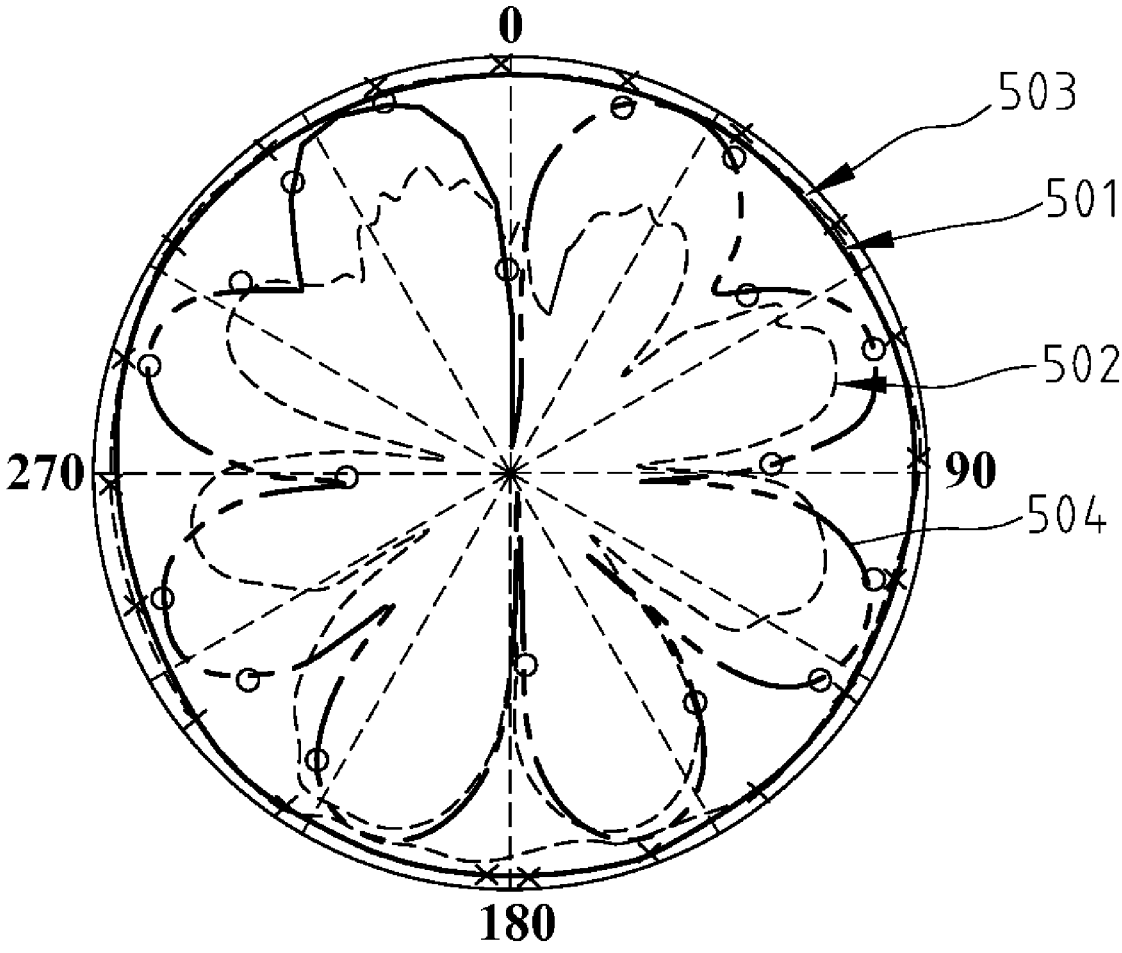
FIG. 6 is a radiation pattern of the antenna in accordance with the present invention in the XY-plane at the frequency of 5.7 GHz.
Figure 7:
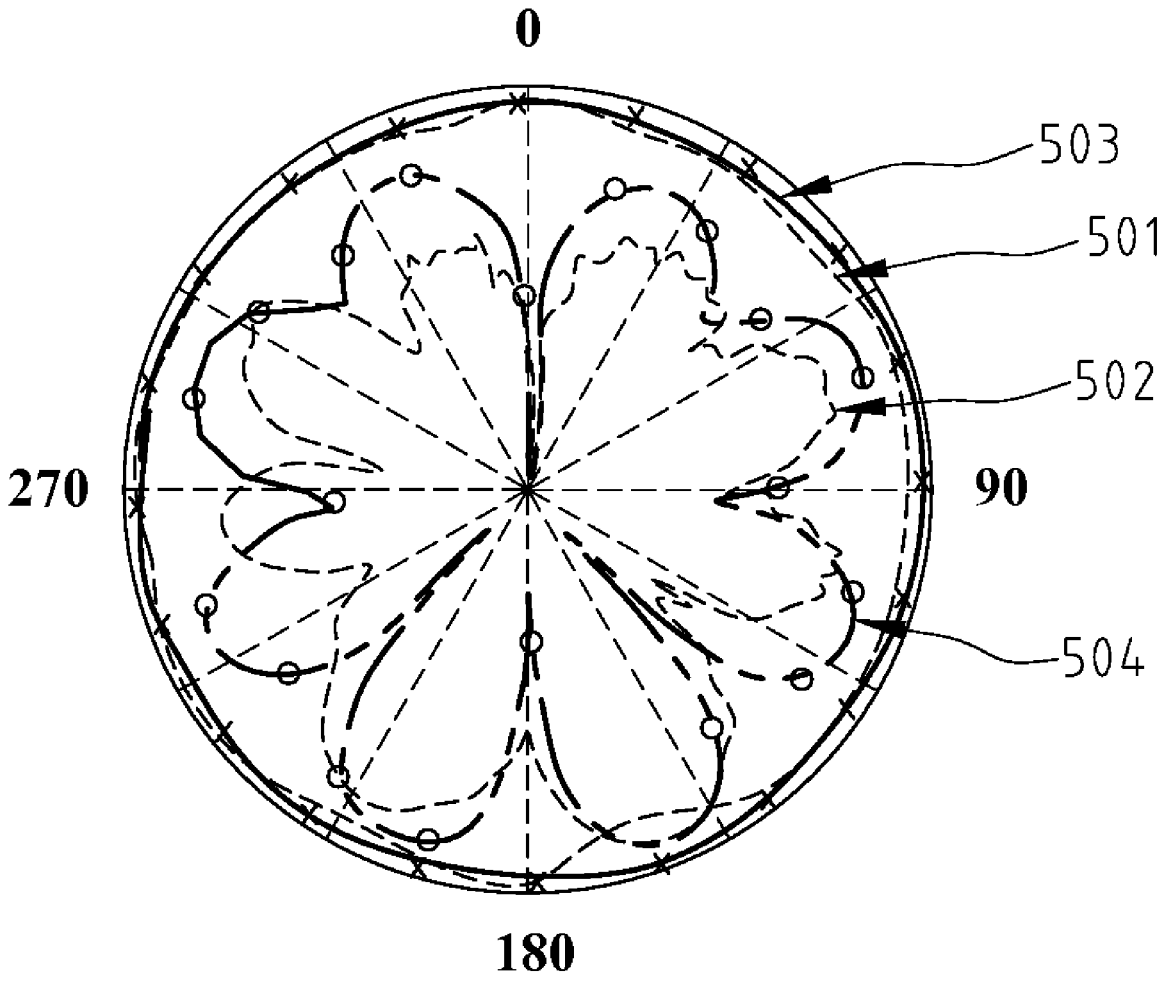
FIG. 7 is a radiation pattern of the antenna in accordance with the present invention in the XY-plane at the frequency of 6.1 GHz.

FIGS. 5-7 are the radiation patterns of the antenna structure in accordance with the present invention in the XY-plane at the frequencies 5.3 GHz, 5.7 GHz, and 6.1 GHz, respectively, wherein the scale from the origin to the perimeter in radial direction is 40 dB. Curve 501 shows the Eθ component measured from experiments, and curve 502 shows the Eϕ component measured from experiments. Curve 503 shows the Eθ component simulated by software, and curve 504 shows the Eϕ component simulated by software. It is apparent from the figures that the radiation pattern of the antenna structure in accordance with the present invention has omnidirectional characteristic, and the frequency bandwidth is greater than that of conventional antennas.

The above-presented description is only intended to illustrate the preferred embodiment in accordance with the present invention, and must not be interpreted as restrictive to the present invention. Therefore, it is apparent that a variety of modifications and changes may be made without departing from the scope of the present invention, which is intended to be defined by the appended claims.

What is claimed is:

1. A wideband dielectric resonator monopole antenna, comprising:

a resonator having a column structure with an exterior surface, a conductive material coated on part of said exterior surface, and a connector extending downwards from the coated part of said exterior surface to a bottom end of said column structure; and a feed-in/feed-out component composed of a wire pattern formed by coating or printing a conductive material on a substrate, said wire pattern having a grounding part formed with the conductive material of said wire pattern, and two parallel slot lines and two open-circuited slot lines formed without the conductive material of said wire pattern;

wherein each said open-circuited slot line is extended perpendicularly from an end of one said parallel slot line towards the other said parallel slot line with said two open-circuited slot lines located between said two parallel slot lines and separated by the conductive material of said wire pattern, and said resonator is disposed above said two open-circuited slot lines with said connector connected to said grounding part of said wire pattern.

2. The antenna as claimed in claim 1, wherein said connector of said resonator is connected to said grounding part of said wire pattern between said two parallel slot lines.

3. The antenna as claimed in claim 1, wherein said substrate is made of a dielectric material selected from the group consisting of FR4, Teflon, Duriod, fiberglass, aluminum oxide, and ceramic materials.

4. The antenna as claimed in claim 1, wherein said resonator has a resonant frequency determined by area of the coated part of said exterior surface.

5. The antenna as claimed in claim 1, wherein impedance matching of said feed-in/feed-out component is determined by length and width of each said open-circuited slot line.

6. The antenna as claimed in claim 1, wherein the length of each said open-circuited slot line is less than the distance between said two parallel slot lines, and the width of each said open-circuited slot line is substantially identical to the width of each said parallel slot line.

7. The antenna as claimed in claim 1, wherein impedance matching and operating frequency of said antenna are determined by dimensions of said resonator and each said open-circuited slot line.

8. The antenna as claimed in claim 1, wherein said resonator is a rectangular column.

9. The antenna as claimed in claim 8, wherein the coated part of said exterior surface includes three adjacent surfaces of said rectangular column.

10. The antenna as claimed in claim 8, wherein a distance from said two open-circuited slot lines to a backside of said rectangular column is in the range of one-seventh to one-sixth of the width of said rectangular column.

* * * * *